US008419339B2

(12) United States Patent
Okumura et al.

(10) Patent No.: US 8,419,339 B2
(45) Date of Patent: Apr. 16, 2013

(54) CONNECTING MEMBER OF CONSTRUCTION MACHINE

(75) Inventors: Masayoshi Okumura, Kobe (JP); Yasuto Kataoka, Kobe (JP)

(73) Assignees: Kobe Steel, Ltd, Kobe-shi (JP); Kobelco Construction Machinery Co., Ltd., Hiroshima-shi (JP)

( * ) Notice: Subject to any disclaimer, the term of this patent is extended or adjusted under 35 U.S.C. 154(b) by 96 days.

(21) Appl. No.: 12/773,264

(22) Filed: May 4, 2010

(65) Prior Publication Data

US 2010/0303541 A1 Dec. 2, 2010

(30) Foreign Application Priority Data

May 26, 2009 (JP) ..... 2009-126494

(51) Int. Cl.
*E02F 3/627* (2006.01)

(52) U.S. Cl.
USPC ..... 414/723; 403/34; 37/468

(58) Field of Classification Search ..... 403/150, 403/151, 157, 159, 361; 414/722; 37/468; 172/272, 273
See application file for complete search history.

(56) References Cited

U.S. PATENT DOCUMENTS 4,192,153 A * 3/1980 Fisher ..... 464/134
6,158,949 A * 12/2000 Walth et al. ..... 414/722
6,202,331 B1 * 3/2001 Kobayashi ..... 37/403
6,962,458 B2 * 11/2005 Takayama et al. ..... 403/34
7,223,061 B2 * 5/2007 Gelb ..... 414/680
7,958,693 B2 * 6/2011 Oyamada et al. ..... 52/831
8,016,540 B2 * 9/2011 Shimoie ..... 414/722
2003/0126772 A1 * 7/2003 Masumoto et al. ..... 37/466
2009/0078667 A1 * 3/2009 Oyamada et al. ..... 212/347
2009/0129908 A1 * 5/2009 Oyamada et al. ..... 414/713
2010/0119344 A1 * 5/2010 Nabata et al. ..... 414/722

FOREIGN PATENT DOCUMENTS

JP 2004-108055 4/2004
WO WO 2008/018194 A1 2/2008

OTHER PUBLICATIONS

Office Action issued Oct. 26, 2011, in Chinese Patent Application No. 201010189779.8 (with partial English-language translation).

* cited by examiner

*Primary Examiner* — Daniel P. Stodola
*Assistant Examiner* — Jonathan Masinick
(74) *Attorney, Agent, or Firm* — Oblon, Spivak, McClelland, Maier & Neustadt, L.L.P.

(57) ABSTRACT

A connecting member of a construction machine has an intermediate support member disposed between first and second support plates. The intermediate support member has a bottom plate formed with a draw-out hole for drawing out a casting mold and disposed facing the boom, and a cover plate continuous with the bottom plate and disposed facing the arm so as to cover the draw-out hole. A projection protruding in a draw-out direction of the casting mold is formed in at least a part of an edge facing the draw-out hole, in the bottom plate, the projection having an inner peripheral wall and an outer peripheral wall with respect to the draw-out hole.

8 Claims, 16 Drawing Sheets

21
21r
21w
t1
21t
t2
21v
24
2f
D
D2
D1

121
121r
121w
t3
H/3
H
21v
24
2f 221B
221A
t4
21w
t2
21v
2f 221D
221C
t4
21w
t2
21v
2f 221F
221E
t5
221y
21w
t2
21v
2f 221H
221G
t5
221x
21w
t2
21v
2f 21w
221J
t6
221z
t2
21v
2f t0
921

CONNECTING MEMBER OF CONSTRUCTION MACHINE

BACKGROUND OF THE INVENTION

1. Field of the Invention

The present invention relates to a connecting member of a construction machine such as an excavator.

2. Description of the Related Art

An excavator, which is a construction machine, comprises a travel device, a main body (a slewing structure) and an attachment (working device). The attachment comprises a boom, an arm attached to the leading end of the boom, and a bucket attached to the leading end of the arm. The leading end of the boom is provided with a boom top (a connecting member), for interconnecting the boom and the arm. The boom top comprises two brackets and an intermediate support member between the brackets.

Although conventional boom tops have employed mainly welded structures (structures in which several parts are interbonded by welding), recently boom tops are often formed by casting. Forming boom tops by casting requires no welding operation, thereby enabling an efficiency in productivity and operational to be improved and allowing the boom top to be shaped to a complex form (this results in allowing the thickness of the various sections of the boom top to be designed in consideration with both local stress concentration and weight reduction). Japanese Patent Application Laid-open No. 2004-108055 discloses a conventional arm-mounting member (boom top) formed by casting.

FIG. 15 is a perspective-view cross-sectional diagram showing an example of a conventional boom top 901. The cross section shown in FIG. 15 corresponds to one in V-V shown in FIG. 3. The boom top 901 has two brackets (FIG. 15 shows only one bracket 911) and an intermediate support member comprising a cover plate 922 and a bottom plate 921. The bracket 911 is formed with a shaft hole 911*h*, into which an arm pin is inserted.

In conventional boom tops, the member between the two brackets (the member is the cover plate 922 in FIG. 15) prevents liquid or the like from entering into the boom.

Furthermore, for weight reduction, the intermediate support member of the boom top (the member comprises a cover plate 922 and a bottom plate 921 in FIG. 15) is formed hollow (refer to FIG. 15 showing an inner space 902*s*). Hence, forming the boom top by casting requires an inner casting mold in addition to an outer casting mold. The boom top further needs a hole for drawing out the inner casting mold (i.e., a draw-out hole). In general, the draw-out hole is formed in the bottom plate (in FIG. 15, a draw-out hole 921*h* is formed in the bottom plate 921).

During the operation of the excavator, an unbalanced load acting on the bucket generates a torsional load acting on the boom and the boom top. Besides, the draw-out hole formed in the bottom plate to remove the casting mold lowers the strength of the periphery of the hole (the "periphery" is the portion Z enclosed by a broken-line circle shown in FIG. 15). When the torsional road acts on the boom top to generate a stress concentration in the periphery, the bottom plate may be brought into fracture.

For this reason, a conventional boom top is provided with a plate as a capping part, which is welded to the edge so as to plug the draw-out hole, in order to reinforce the bottom plate (the "capping part" is shown as a cap 970 in FIG. 15).

However, as a first problem, this case involves a welding operation for the capping part, which increases the time and costs for manufacturing the boom top.

Moreover, as a second problem, the attached capping part increases the weight of the boom top, thus causing a requirement of a heavier counterweight. For this reason, a lighter boom top is desired.

SUMMARY OF THE INVENTION

It is an object of the present invention to provide a castable connecting member of a construction machine, which member has a light weight and a high strength while requiring no welding operation for forming itself.

In order to solve the above problems, the invention provides a connecting member of a construction machine, which is a casting for connecting a boom and an arm, comprising: a first support plate having a first shaft hole through which an arm pin is inserted; a second support plate disposed parallel to the first support plate and having a second shaft hole through which the arm pin is inserted; and an intermediate support member being continuous with the first and second support plates and disposed between the first and second support plates.

The intermediate support member, inside which a space is formed, has (i) a bottom plate formed with a draw-out hole for drawing a casting mold out of the intermediate support member and disposed at a position facing the boom, and (ii) a cover plate which is continuous with the bottom plate and disposed at a position facing the arm so as to cover the draw-out hole.

Moreover, the connecting member satisfies at least one of the following conditions I and II.

I) A projection protruding in a draw-out direction of the casting mold is formed in at least a part of an entire perimeter of an edge facing the draw-out hole, in the bottom plate.

II) At least a part of an entire perimeter of an edge facing the draw-out hole, in the bottom plate, has a thickness greater than a minimum thickness of the cover plate.

DESCRIPTION OF THE PREFERRED EMBODIMENTS

There will be explained a first embodiment of the present invention below with reference to the drawings. In the explanation below, top "down", "left" and "right" correspond to top down, "left" and "right" in the figures, respectively. FIG. 4 is equivalent to a drawing viewed along arrow B in FIG. 3.

Figure 1:
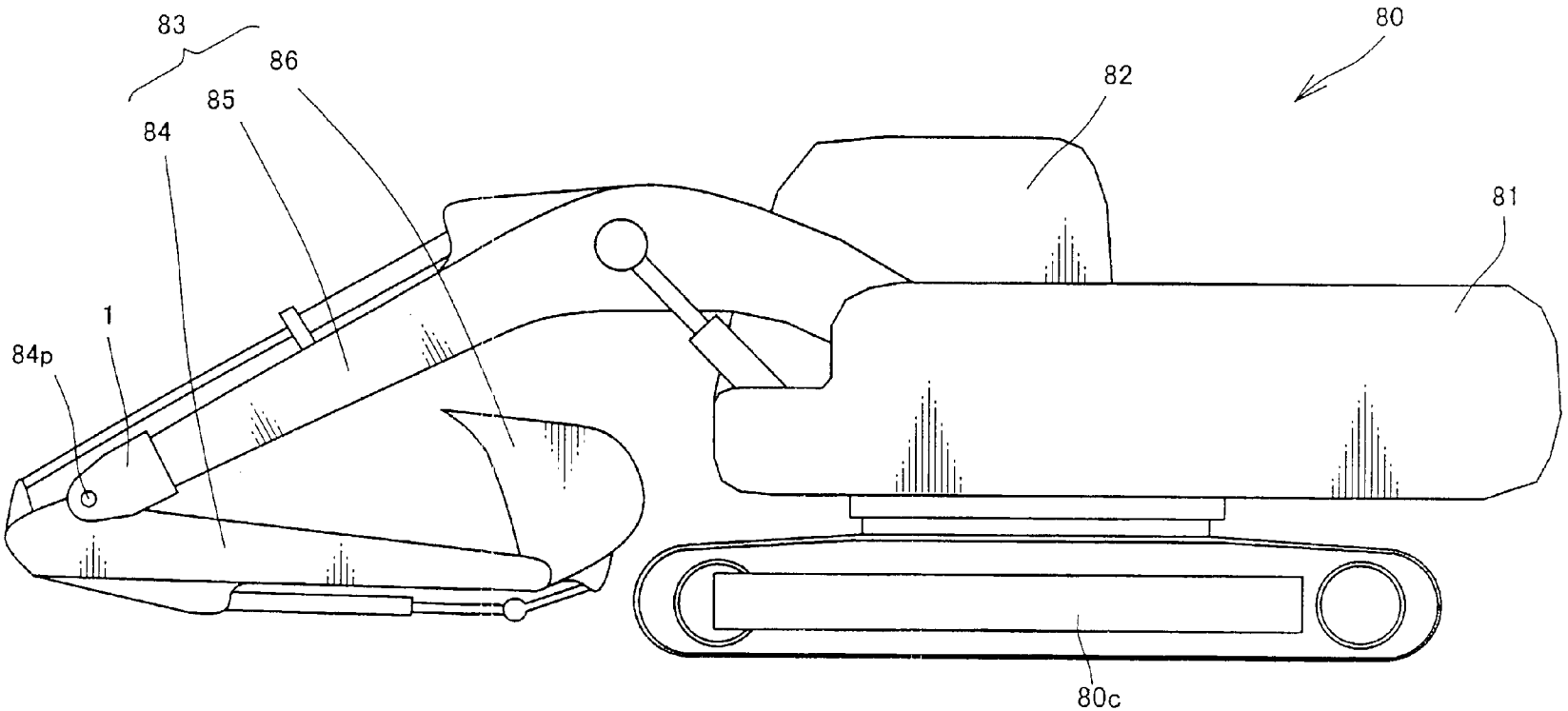
FIG. 1 is an overall side-view diagram of an excavator according to a first embodiment.

As shown in FIG. 1, an excavator 80 according to the present embodiment comprises a travel device 80*c*, a main body, and an attachment 83. The main body is a slewing structure, comprising a cabin 82 and a counterweight 81. The attachment 83 comprises a boom 85, an arm 84 and a bucket 86. The boom is attached to the body. The arm 84 is attached to the leading end of the boom 85. The bucket 86 is attached to the leading end of the arm 84.

Figure 2:
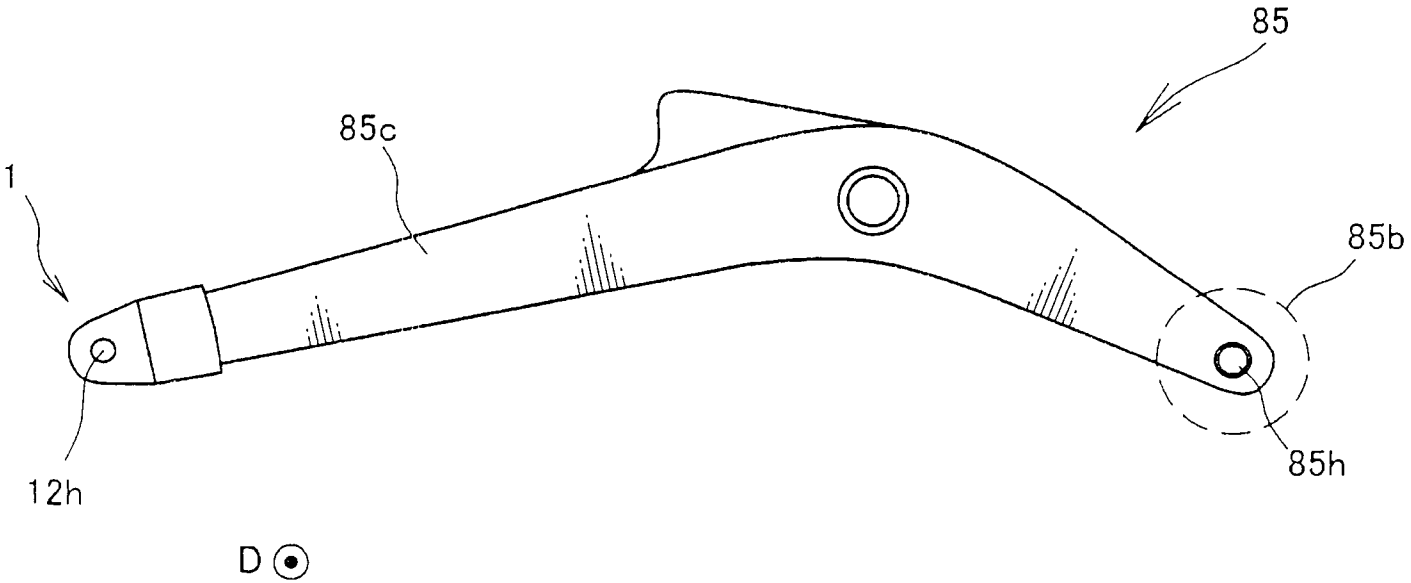
FIG. 2 is a side-view diagram of a boom and a boom top.

As shown in FIG. 2, the boom 85 is provided with a connecting section 85*b* at one end thereof, attached to the main body at the connecting section 85*b*. The connecting section 85*b* has a through hole 85*h*, through which a connecting pin (not shown), a rotation shaft of the boom 85, is inserted.

As shown in FIGS. 1 and 2, a boom top (connecting member) 1 for interconnecting the boom 85 and the arm 84 is attached to the other end of the boom 85. Specifically, the leading end of the boom 85 is inserted into the boom top 1. The boom top 1 has shaft holes (namely, a first shaft hole 11*h* and a second shaft hole 12*h* shown in FIG. 3), into which an arm pin 84*p*, a rotation shaft of the arm 84, is inserted.

The boom 85 is rotatable up and down about the connecting pin relatively to the main body. The arm 84 is rotatable up and down about the arm pin 84*p* relatively to the boom 85.

Next will be explained the entire configuration of the boom top 1. The boom top 1 is a connecting member for interconnecting the arm 84 and the boom 85 as described above, while being a casting. The boom top 1 is formed of cast steel; however, cast iron may also be used as the material of the boom top.

Figure 3:
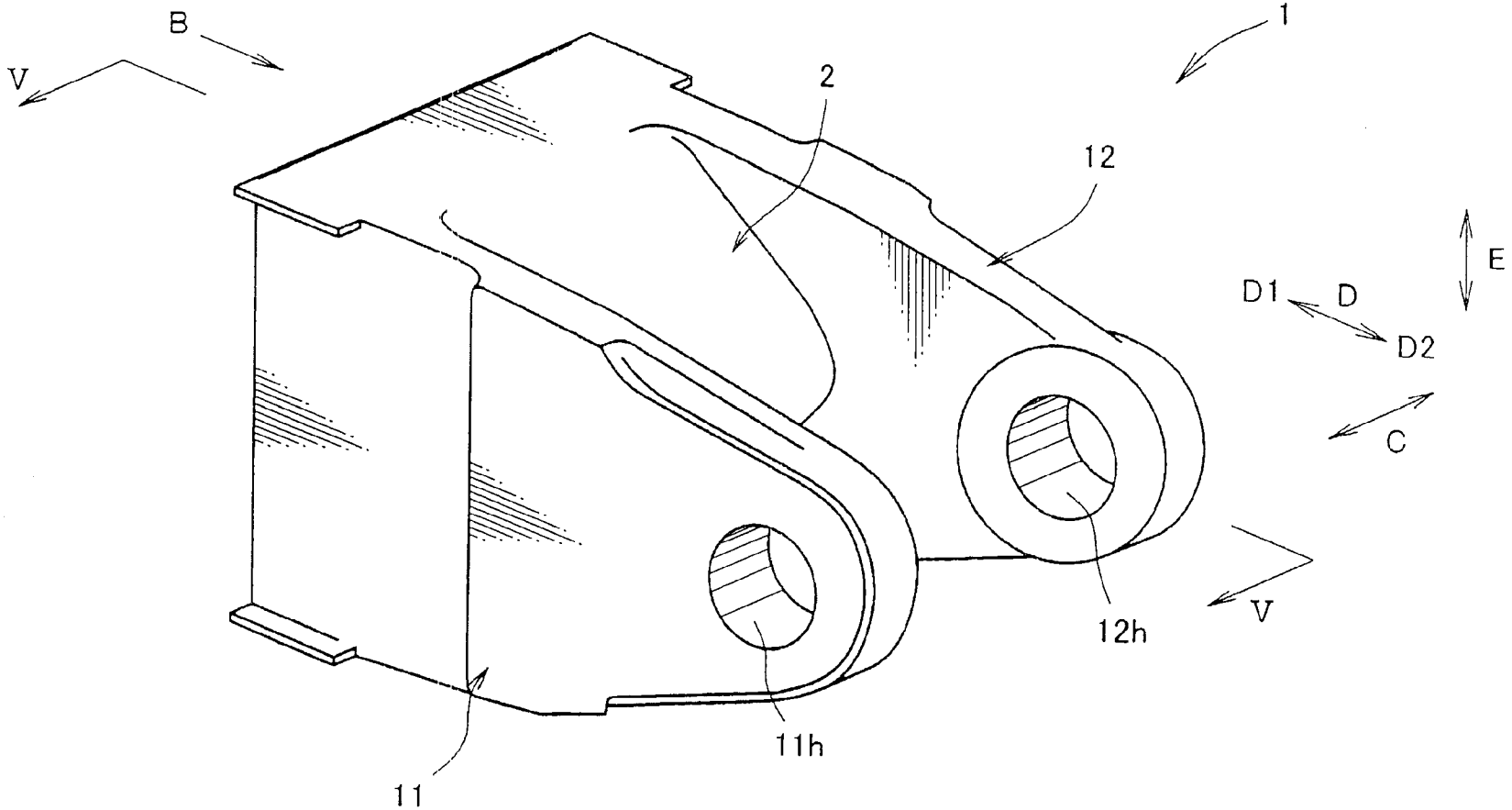
FIG. 3 is a perspective-view diagram of the boom top.
Figure 4:
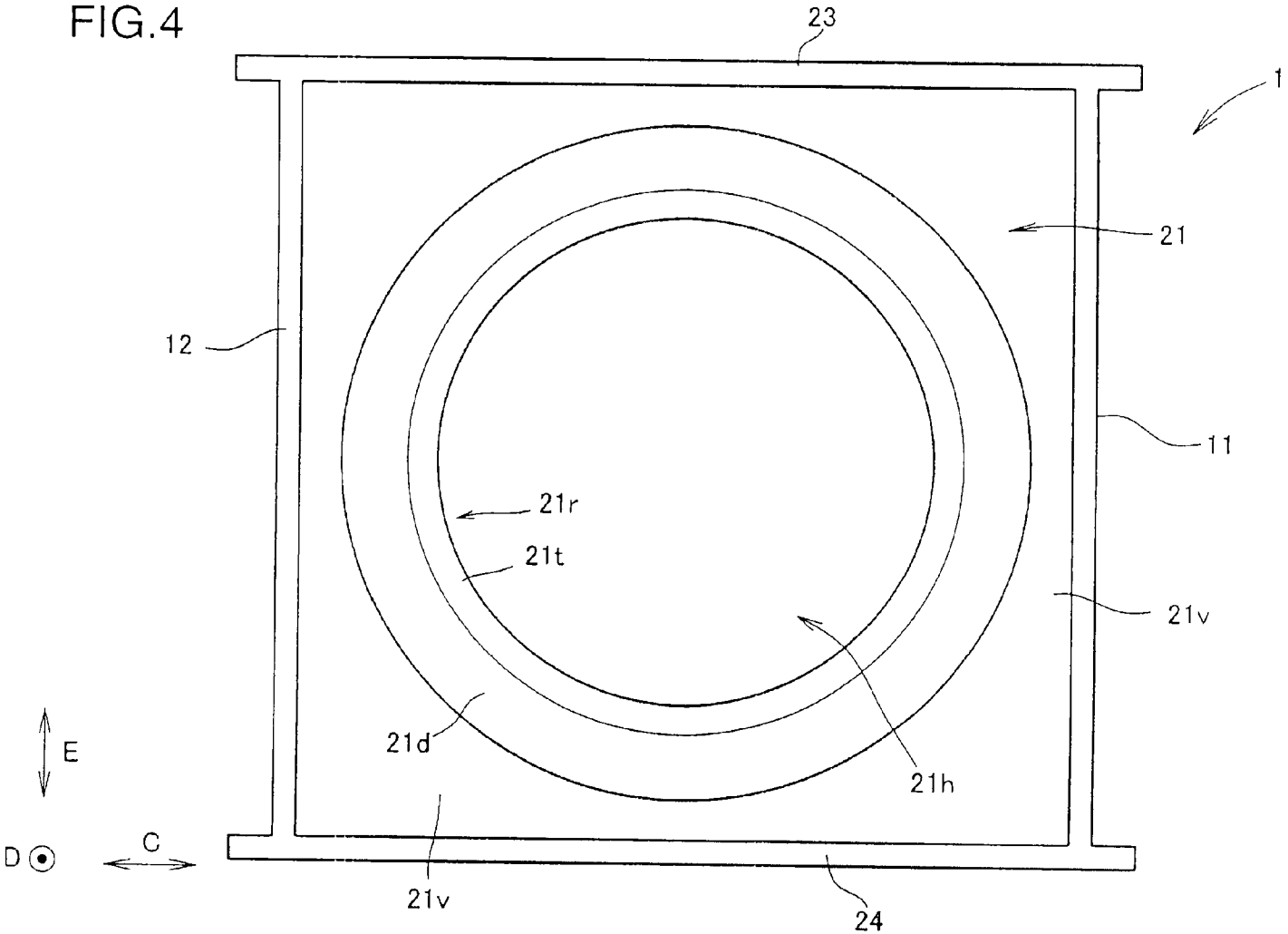
FIG. 4 is a bottom-view diagram of the boom top.

The boom top 1 comprises a first support plate and a second support plate (namely, a first bracket 11 and a second bracket 12 in this embodiment), and an intermediate support member 2 between the first and second support plates (FIG. 3). The intermediate support member 2 includes a bottom plate 21 and a cover plate 22. The various elements are explained below.

Figure 5:
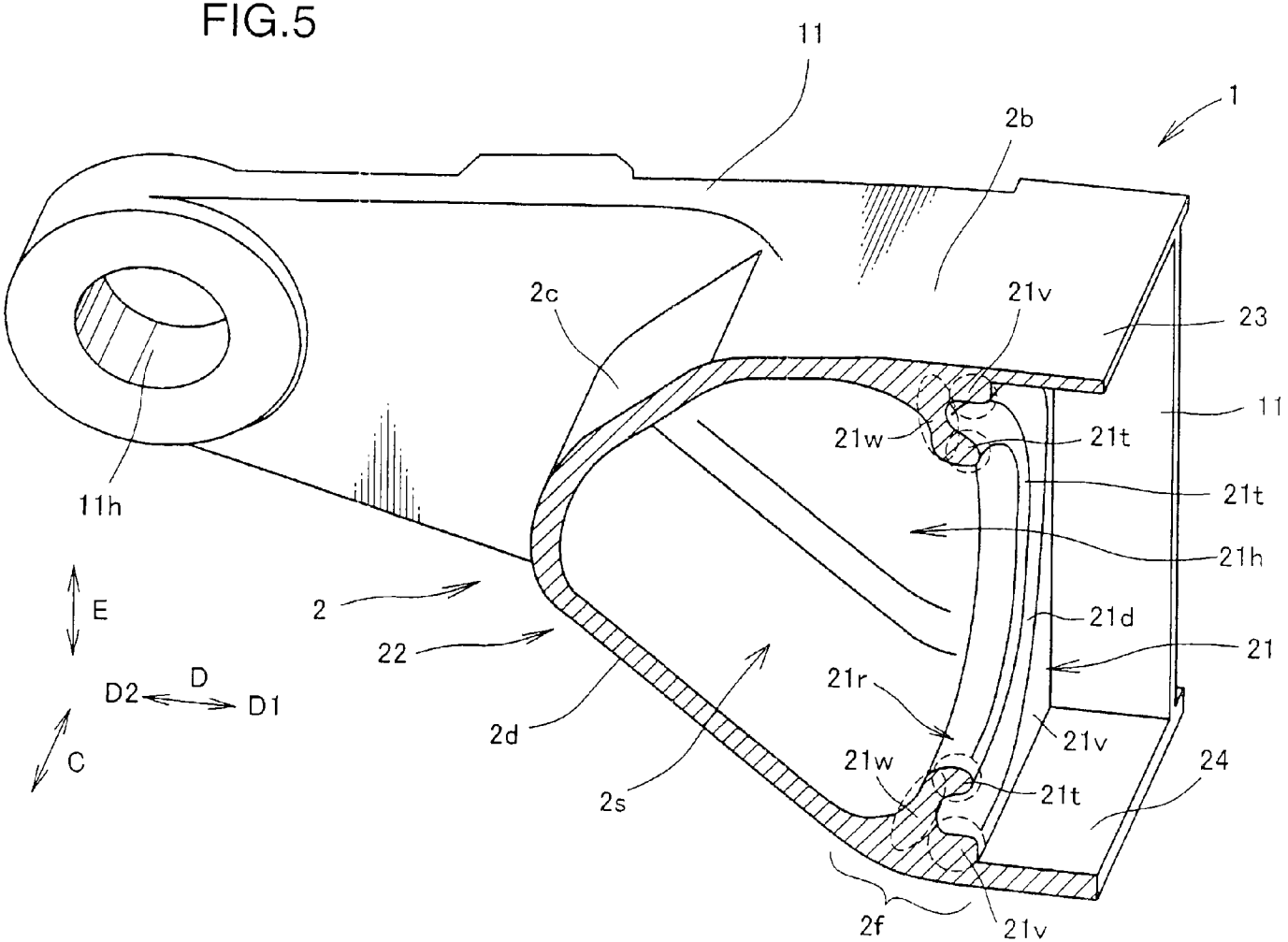
FIG. 5 is a perspective-view cross-sectional diagram of FIG. 3 along V-V.
Figure 6:
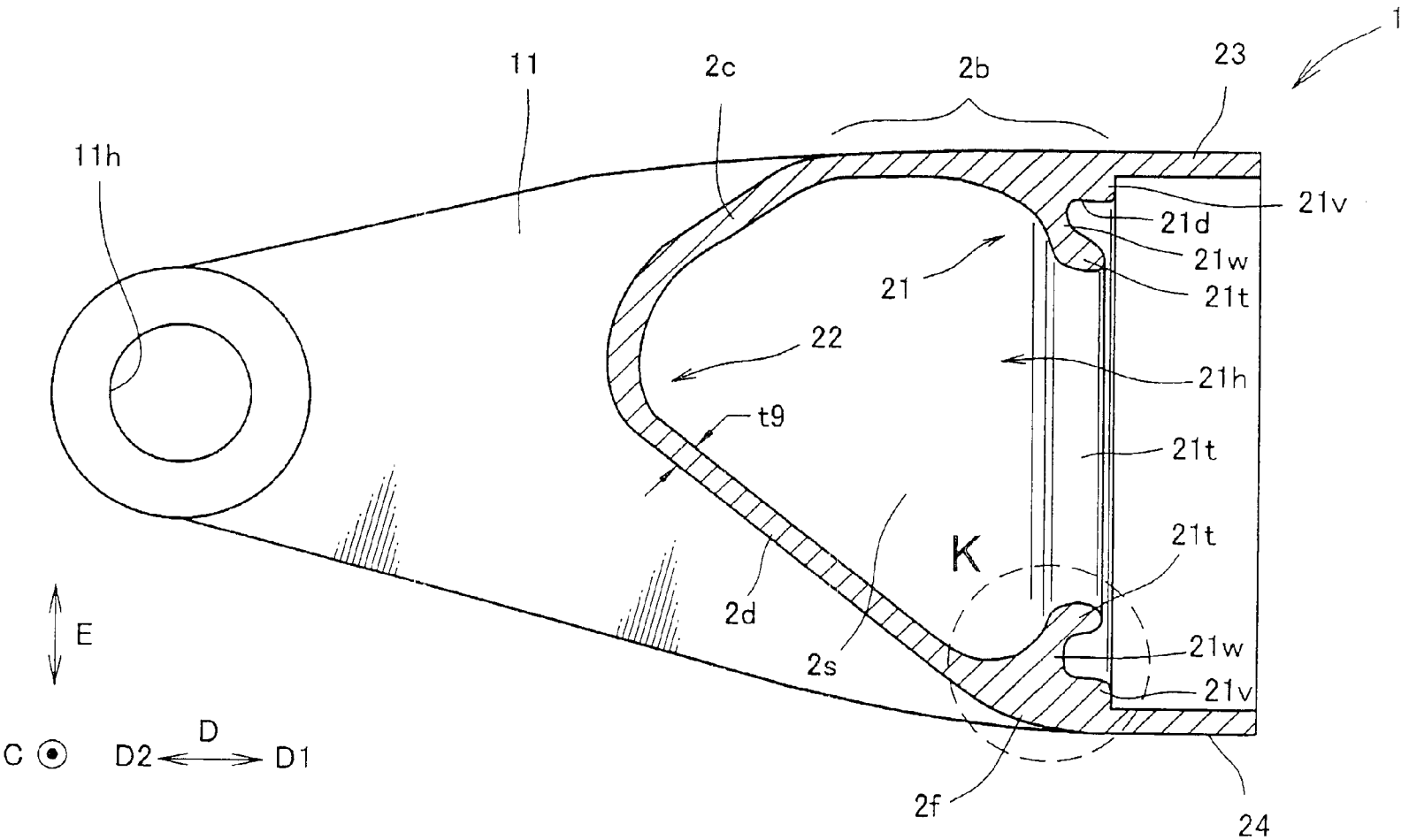
FIG. 6 is a cross-sectional diagram of FIG. 3 along V-V.

The first and second support plates, i.e. the first bracket 11 and the second bracket 12, are plate-like members disposed parallel to each other (FIG. 3, FIG. 5 and FIG. 6). The first bracket 11A has the first shaft hole 11*h* formed in the bracket 11A, while the second bracket 12 has the second shaft hole 12*h* formed in the bracket 12A. For interconnecting the boom 85 and the arm 84, the arm pin 84*p* is inserted through the shaft holes 11*h* and 12*h*. The directions of arrow C in the figures are axial directions of the arm pin 84*p* when it is inserted through the shaft holes of the boom top 1. The first and second support plates are disposed perpendicularly to the axial directions C.

The directions of arrow D in the figures are draw-out directions of the casting mold. The draw-out directions D include a frontward direction D1 and a rearward direction D2 as shown in FIGS. 3, 5 and 6. The directions of arrow E in the figures are perpendicular to the draw-out directions D and the axial directions C.

In each bracket, the shaft hole (the first shaft hole 11*h* or the second shaft hole 12*h*) is formed in a region of the end in the direction D2. The length of the bracket in directions E is shortest at the end in the direction D2, while longest at the end in the direction D1 (see FIG. 6).

The intermediate support member 2 is formed to be continuous with the first and second support plates, disposed between the first and second support plates. Inside the intermediate support member 2 comprising the bottom plate 21 and the cover plate 22, an inner space 2*s* is formed. The first and second support plates, in the boom top 1, are strongly joined to each other by way of the intermediate support member 2.

The cover plate 22 and the bottom plate 21 are explained below.

The cover plate 22 is continuous with the bottom plate 21, disposed at a position facing the arm 84 so as to cover the draw-out hole 21*h* (described below, see FIG. 5). The cover plate 22 prevents a liquid or the like from entering into the boom 85.

The cover plate 22 comprises a first fin 23, a first plate 2*b*, a second plate 2*c*, a third plate 2*d*, a fourth plate 2*f* and a second fin 24. The first fin 23, the first plate 2*b*, the second plate 2*c*, the third plate 2*d*, the fourth plate 2*f* and the second fin 24 are formed continuous with each other in this order. These plate parts constituting the cover plate 22 are all continuous to the first and second support plates. The cover plate 22 is formed so as to extend in the axial directions C. The shape of the cover plate 22 in any cross sections thereof perpendicular to the axial direction C is constant.

The first fin 23 is a top plate and the second fin 24 a bottom plate. The first and second fins 23 and 24 are formed as flat plates, perpendicular to the directions E.

The cover plate 22 is formed into U-shape in a cross section perpendicular to the axial direction C, the first fin 23 and the second fin 24 constituting the both ends of "U"(see FIG. 5 and FIG. 6). The positions of the end faces of the first fin 23 and the second fin 24 (that is, the end face in the direction D1 of the draw-out directions D) coincides with the end face positions of the first bracket 11 and the second bracket 12.

The first and second fins 23 and 24 are positioned in the end of the cover plate 22 in the direction D1. The joint between the second plate 2*c* and the third plate 2*d* is positioned in the end of the cover plate 22 in the direction D2.

The second plate 2*c* and third plate 2*d* extend from their joint towards the first fin 23 and the second fin 24, respectively. The second plate 2*c* and the third plate 2*d* are joined in a V shape, disposed facing the draw-out hole 21*h* in the draw-out directions D. The thickness of the second plate 2*c* and the third plate 2*d* is t9 (see FIG. 6), which is the smallest (minimum) thickness of the cover plate 22.

The first plate 2*b* is continuous with the second plate 2*c* and perpendicular to directions E, similarly to the first fin 23. The first fin 23 is continuous with the first plate 2*b*.

The fourth plate 2*f* is continuous with the third plate 2*d*. The second fin 24 is continuous with the fourth plate 2*f*. The fourth plate 2*f* joins the second fin 24 and the third plate 2*d*, curving in the cross section perpendicular to the axial directions C (see FIG. 5 and FIG. 6).

Figure 12B:
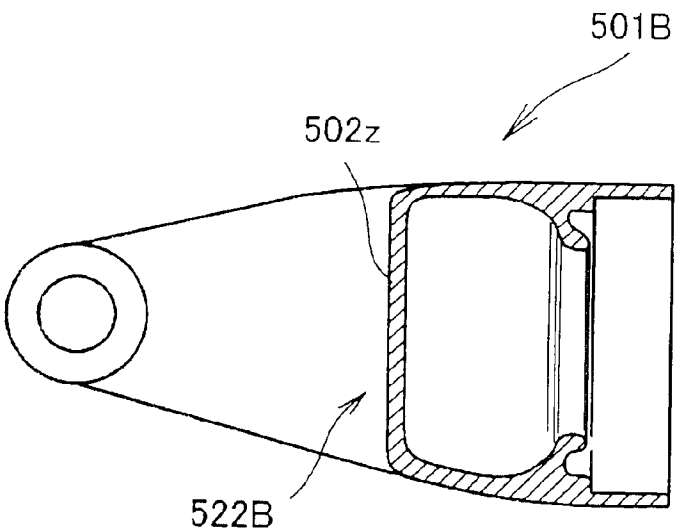
FIG. 12 is a set of cross-sectional diagrams of a boom top according to a fifth and a sixth embodiment.
Figure 12A:
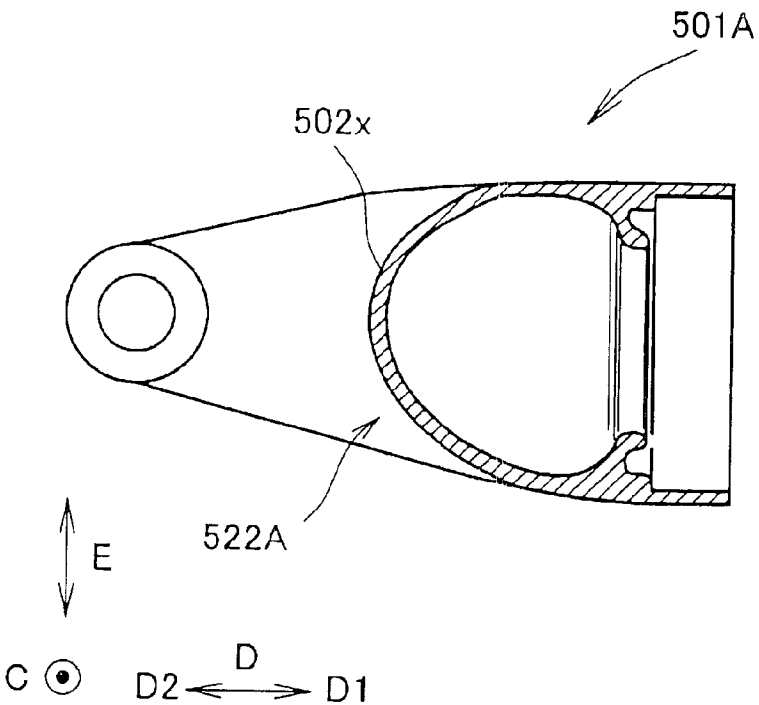

The shape of the cover plate is not limited to the above-described one. For instance, as shown in FIG. 12A, a boom top 501A may comprise a cover plate 522A including a substantially constant-curvature curved section 502*x*, instead of the first plate 2*b*, the second plate 2*c* and the third plate 2*d*. Alternatively, as shown in FIG. 12B, a boom top 501B may comprise a cover plate 522B including a flat plate 502*z* perpendicular to the draw-out directions D.

The bottom plate 21 is shaped as a flat plate and provided at a position facing the boom 85. The bottom plate 21 is perpendicular to the draw-out directions D and parallel to both directions E and the axial directions C. The bottom plate 21 is continuous with the first and second support plates (see FIG. 4 to FIG. 6).

The draw-out hole 21*h* is circular and formed in the center of the bottom plate 21 (see FIG. 4 and FIG. 5), in order to draw out the inner casting mold therethrough during the manufacture of the boom top 1.

The cover plate 21 is continuous with the bottom plate 22. Specifically, the bottom plate 21 is joined to the first plate 2*b* and the fourth plate 2*f* of the cover plate 22 (see FIG. 5 and FIG. 6). This means that the respective ends of the first and second brackets 11 and 12 in the direction D1, the first fin 23 and the second fin 24 extend beyond the bottom plate 21 in the direction D1 (see FIG. 5). In other words, the bottom plate 21 is disposed at a position retreating in the direction D2 from the end face position, in the direction D1, of the first bracket 11, the second bracket 12 and the cover plate 22. The bottom plate 21, the first fin 23, the first bracket 11, the second fin 24 and the second bracket 12 form a space (or a recess), into which the leading end of the boom 85 is inserted. The boom top may also be formed so as to be inserted into the leading end of the boom 85.

The bottom plate 21 has a main body 21*w*, a thick section 21*v* and a projection 21*t* (see FIG. 5). The main body 21*w* is a plate-like portion having a thickness t2 (see FIG. 9A). The thick section 21*v* is formed at the outer edge of the bottom plate 21 (that is, a part of the bottom plate 21 which part is adjacent to the first plate 2*b*, the fourth plate 2*f*, the first bracket 11 and the second bracket 12). In the outer edge, the sum of the thickness of the thick section 21*v* and the thickness of the main body 21*w* yields the total thickness of the bottom plate 21. The main body 21*w* and the thick section 21*v* are formed perpendicularly to the draw-out directions D.

The periphery of the draw-out hole 21*h* of the bottom plate 21 (that is, a portion facing the draw-out hole 21*h* inwardly) constitutes an edge 21*r*. The edge 21*r* has a ring shape. The projection 21*t* is formed over the entire perimeter of the edge 21*r*. The projection 21*t* protrudes from the leading end of the main body 21*w*, in the direction D1 of the draw-out directions D (see FIG. 5 and FIG. 6). This results in a groove 21*d* formed between the thick section 21*v* and having a bottom formed of the main body 21*w*.

Figure 13B:
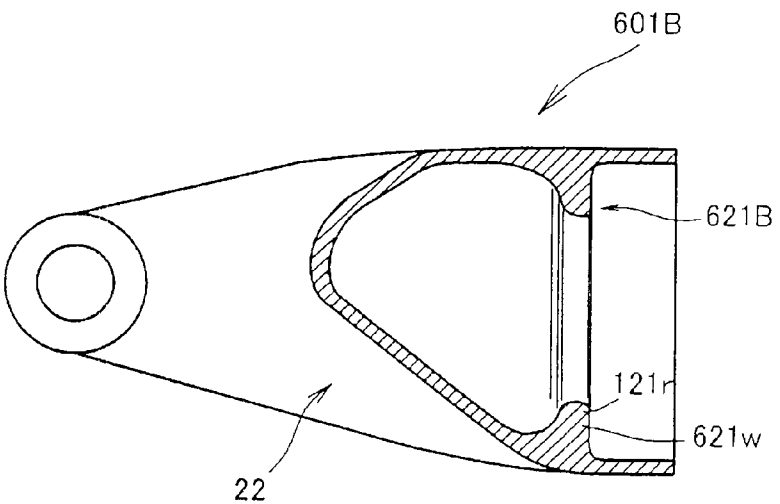
FIG. 13 is a set of cross-sectional diagrams of a boom top according to a seventh and an eighth embodiment.
Figure 13A:
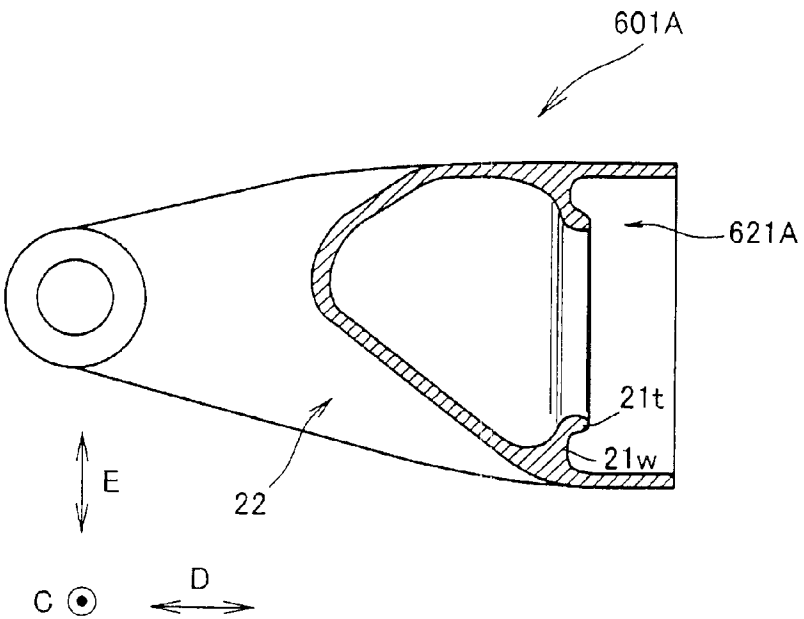

The thick section 21*v* may be omitted, as in the bottom plate 621A of a boom top 601A shown in FIG. 13A. Also, the bottom plate 621A may be constituted only by the main body 21*w* and the projection 21*t*.

Figures 9A, 9B, 9C, 9D, 9E, 9F, 9G, 9H:
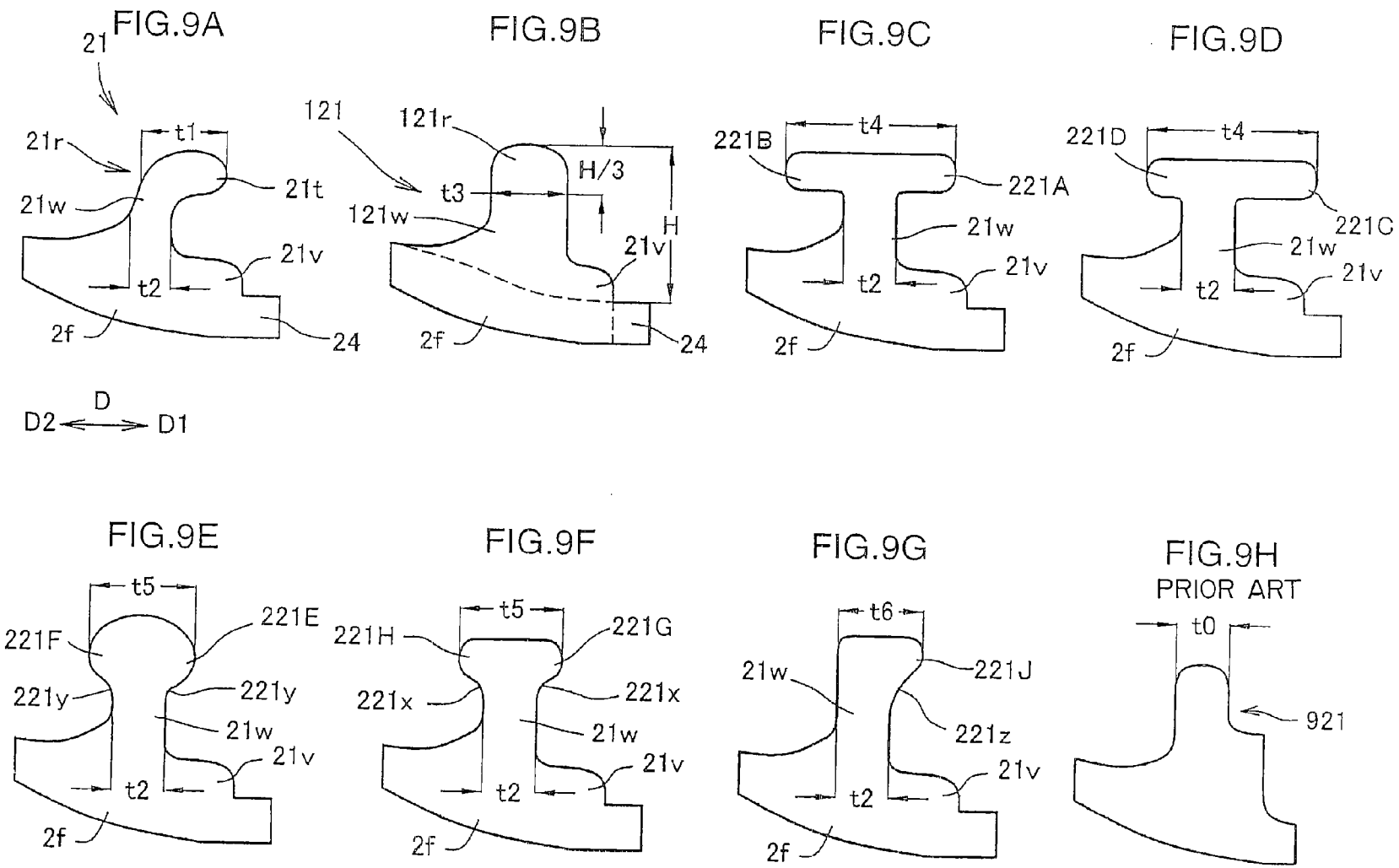
FIG.9H PRIOR ART
FIG. 9 is a set of cross-sectional schematic diagrams showing the shape of an edge according to the first embodiment, the second embodiment and first to fifth modifications, as well as the shape of a conventional edge.

Next is explained about FIG. 9A to 9H. Any of these drawings show a cross section being parallel to the draw-out directions D and containing the center of the draw-out hole. The cross sections shown in FIG. 9A is equivalent to the portion enclosed by the broken line K in FIG. 6. FIGS. 9B to 9G are not explained here and will be described later.

In FIG. 9A, the edge 21*r* has a thickness t1, which is the thickness of the main body 21*w* and the projection 21*t*. The bottom plate 21 satisfies the relationship t2<t1. The thickness t2 is equal to the t9 in FIG. 6. Specifically, the thicknesses t2 and t9 satisfy the following relationship.

$$(0.8\times t9)<t2<(1.2\times t9)$$

Besides, each of t2 and t9 are equal to t0 which is a thickness of the edge of the bottom plate 921 in the conventional boom top shown in FIG. 9H.

As shown in FIG. 9A, the projection 21*t* has a semi-elliptical shape in the cross section being parallel to the draw-out directions D and containing the center of the draw-out hole 21*h*.

FIG. 6 and FIG. 9A show a cross section parallel to the draw-out directions D and perpendicular to the axial directions C, among the cross sections including the draw-out hole 21*h*.

In the boom top 1, the projection 21*t* is formed uniformly over the entire perimeter of the edge 21*r*. As a result, the shape of the cross section of the edge 21*r* is expressed similar to that of the edge 21*r* in FIG. 6 and in FIG. 9A, even if that cross section is not parallel to the axial direction C, so long as the cross section is parallel to the draw-out direction D and includes the center of the draw-out hole 21*h* (i.e. a cross section perpendicular to the direction along which the edge of the draw-out hole 21*h* extends).

Next will be explained a method for manufacturing the boom top 1.

(i) Firstly, there is set the thickness of each section of the bottom plate 21 (setting step). Specifically, the bottom plate 21 is designed so as to satisfy the relationship t1>t2.

(ii) Cast steel, which is the material of the boom top 1, is liquefied through heating to a temperature higher than the melting point (heating step).

(iii) The liquid cast steel is then poured into a casting mold (pouring step).

(iv) The casting mold is cooled to cool and solidify the liquid cast steel (cooling step).

(v) The outer casting mold is taken apart, and the casting, having still the inner casting mold accommodated in the interior, is removed from the outer casting mold. The inner casting mold is then draw out through the draw-out hole 21*h*, in the direction D1 of the draw-out directions D (demolding step). The boom top 1 is thus manufactured.

In the boom top 1, which is a finished article, the maximum height (and the maximum width) of the inner space 2*s* is greater than the diameter of the draw-out hole 21*h*, while the inner casting mold is a split mold comprising a plurality of parts. Therefore, in the above demolding step, all the mold parts that make up the inner casting mold can be drawn out of the boom top 1 without being caught by the bottom plate 21, if being drawn out sequentially from the mold parts in the center.

The boom top 1, which is a casting for interconnecting the boom 85 and the arm 84, comprises the first and second support plates (the first bracket 11 and the second bracket 12) disposed parallel to each other and having respective shaft holes (the first shaft hole 11*h* and the second shaft hole 12*h*) through which the arm pin 84*p* is inserted; and the intermediate support member 2 being continuous with the first and second support plates and disposed between the first and second support plates.

The inner space 2*s* is formed in the intermediate support member 2. The intermediate support member 2 has (i) the bottom plate 21 having the draw-out hole 21*h* formed therein for drawing out the casting mold and disposed at a position facing the boom 85; and (ii) the cover plate 22 being continuous with the bottom plate 21 and disposed at a position facing the arm 84 so as to cover the draw-out hole 21*h*. The projection 21*t*, formed over the entire perimeter of the edge 21*r* of the bottom plate 21 facing the draw-out hole 21*h*, projects in the draw-out directions D of the casting mold.

The boom top 1, manufactured by casting, allows the thickness of the various sections thereof to be designed in consideration of both local stress concentration and reduction of the weight of the entire boom top 1.

Having no capping part permits the boom top to be lighter than a boom top having a capping part. Besides, requiring no welding of the capping part contributes to a shorten time and a lowered cost for manufacturing the boom top.

Furthermore, the projection 21*t* formed on the edge 21*r* reinforces the edge 21*r*, thereby suppressing the breakage of the bottom plate 21 due to a torsional load acting on the boom top 1 to generate stress concentration in the edge 21*r*.

The above-mentioned configuration affords a lightweight, highly strong boom top 1 requiring no welding.

Besides, in the boom top 1, forming the projection uniformly over the entire perimeter of the edge 21*r* enables the bottom plate 21 to be reliably reinforced even when where the stress will occur in the edge 21*r* cannot be predicted.

Second Embodiment

Figure 7:
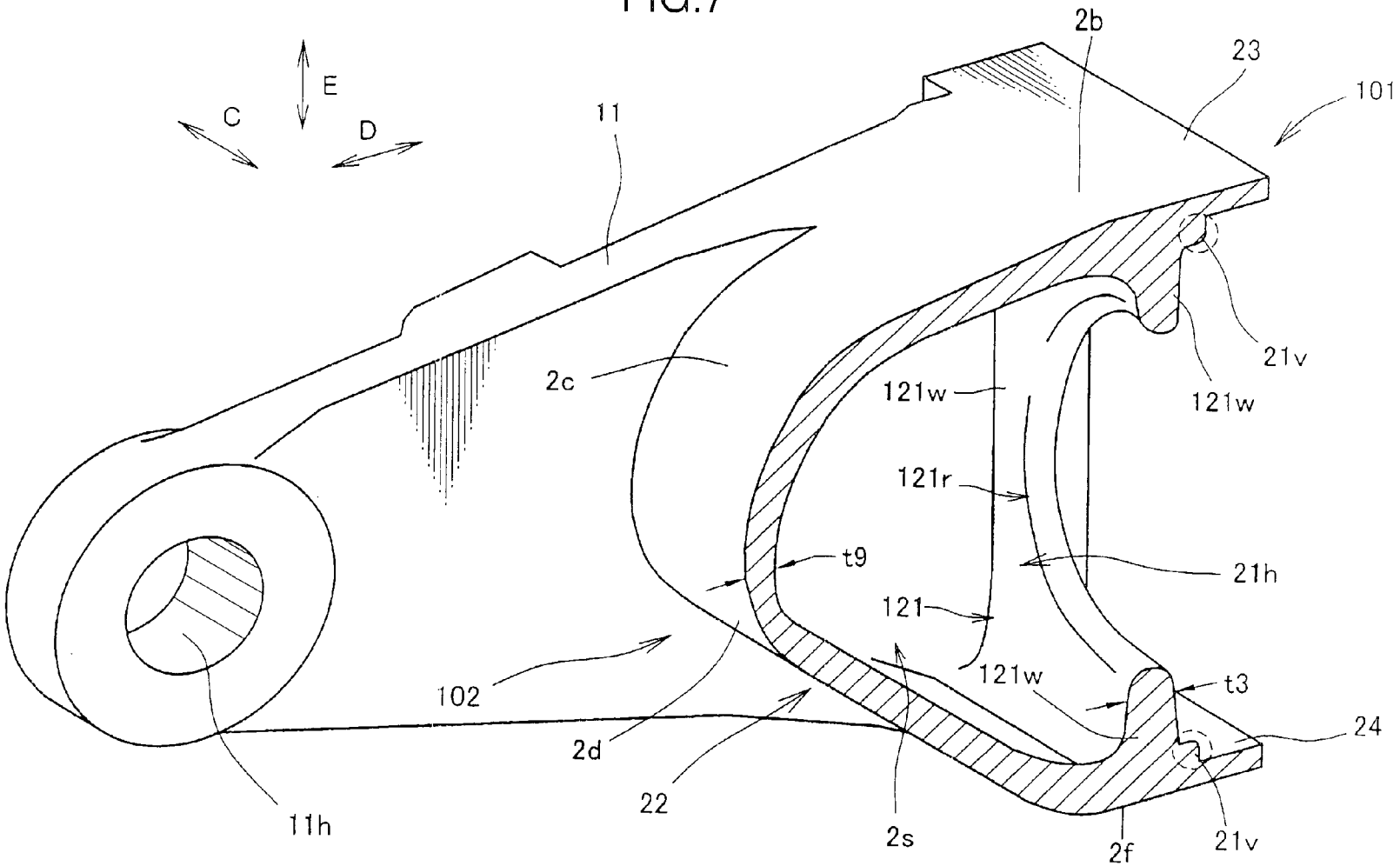
FIG. 7 is a perspective-view cross-sectional diagram of a boom top according to a second embodiment.

Next will be explained a second embodiment of the present invention with reference to FIG. 7 and FIG. 9B. Elements identical to those of the above embodiment are denoted with the same reference numerals, and a recurrent explanation thereof will be omitted. FIG. 7 is a perspective-view cross-sectional diagram of a boom top according to the second embodiment. The explanation below will focus on elements that differ from the elements in the first embodiment. Features identical to those of the first embodiment will not be explained again. The thickness t9 corresponds to the t9 of the above-described embodiment. The cross section position in FIG. 7 corresponds to the position V-V in FIG. 3.

A boom top 101 according to this embodiment includes a bottom plate 121, whose shape is different from that of the above bottom plate 21. The bottom plate 121 comprises a main body 121*w* and a thick section 21*v*, not including the above-described projection 21*t*. The entire main body 121*w* is entirely thicker than the above-described main body 21*w*. In other words, the bottom plate 121 has an edge 121*r* which is thickened to be reinforced (refer to the part with the thickness t3 in the main body 121*w*).

The thickness t3 of the edge 121*r* of the bottom plate 121 is greater than the minimum thickness t9 of the cover plate 22, over the entire perimeter of the edge 121*r* (see FIG. 7 and FIG. 9B). As shown in FIG. 9B, the "thickness of the edge 121*r*" is defined as the "thickness of the bottom plate 121 at a position removed from the leading end of the edge by ⅓ of the height H thereof with respect to a base (fourth plate 2*f*)".

Next will be explained a method for manufacturing the boom top 101.

Firstly, there is set the thickness of each portion of the bottom plate 21 (setting step). Specifically, the bottom plate 121 is designed so as to satisfy the relationship t3>t9. Other steps, that is, a heating step, pouring step, cooling step and demolding step, are equivalent to those of the above-described embodiment, not explained again.

The boom top 101 is thus manufactured.

The boom top 101, which is a casting for interconnecting the boom 85 and the arm 84, comprises first and second support plates (the first bracket 11 and the second bracket 12) disposed parallel to each other and having respective shaft holes (the first shaft hole 11*h* and the second shaft hole 12*h*) through which the arm pin 84*p* is inserted; and an intermediate support member 102 being continuous with the first and second support plates and disposed between the first and second support plates.

An inner space 2*s* is formed in the intermediate support member 102. The intermediate support member 102 has (i) the bottom plate 121 having the draw-out hole 21*h* formed therein for drawing out the casting mold and disposed at a position facing the boom 85; and (ii) the cover plate 22 being continuous from the bottom plate 121 and disposed at a position facing the arm 84 so as to cover the draw-out hole 21*h*. The thickness t3 over the entire perimeter of the edge 121*r* of the bottom plate 121 facing the draw-out hole 21*h* is greater than the minimum thickness t9 of the cover plate 22.

Since the boom top (connecting member) 101 is manufactured by casting, the thickness of the various sections of the boom top 101 is allowed to be designed in consideration of both local stress concentration and reduction of the weight of the entire boom top 101.

Having no capping part permits the boom top to be lighter than a boom top having a capping part. Besides, requiring no welding of the capping part contributes to a shorten time and a lowered cost for manufacturing the boom top.

Furthermore, thickening the edge 121*r* of the bottom plate 121 to reinforce it suppresses the breakage of the bottom plate 21 when a torsional load acts on the boom top 101 to generate stress concentration in the edge 21*r*.

Thus provided is a lightweight, highly strong boom top 101 requiring no welding.

Besides, in the boom top 101, the thickness t3 of the edge 121*r* facing the draw-out hole 21*h* in the bottom plate 121 of the boom top 101 is greater than the smallest thickness t9 of the cover plate 22, over the entire perimeter of the edge 121*r*; this enables the bottom plate 21 to be reliably reinforced even when where the stress will occur in the edge 21*r* cannot be predicted.

Thickening and reinforcing the edge 121*r* without forming the projection 21*t* prevents a stress concentration from occurring at the basal part of the projection. Besides, the amount of casting melt flow is saved compared with a case of providing projections, which establishes a good casting yield.

The thick section 21*v* may be omitted, as in the bottom plate 621B of a boom top 601B shown in FIG. 13B. The bottom plate 621B shown in FIG. 13B is constituted only by a main body 621*w*.

Next will be explained an example of the boom top 101 according to the second embodiment with reference to FIG. 8. Here is performed a torsion test (numerical analysis) on the boom top 101.

(Test Details)

There were pulled the vicinity of the first shaft hole 11*h* of the first bracket 11 and the vicinity of the second shaft hole 12*h* of the second bracket 12 in opposite directions (direction of arrow F and arrow F' in the figures) respectively, along the directions E. Then, measured was the von Mieses stress (MPa) generated in the boom top 101 on account of the torsional load. As to the test condition, an allowable stress of the bottom plate 121 is 125 MPa for pulsating stress, while being 250 MPa for reversed stress.

On the other hand, as a comparative example, a conventional boom top 801 (see FIG. 14, described below) was tested under the same conditions.

Figure 15:
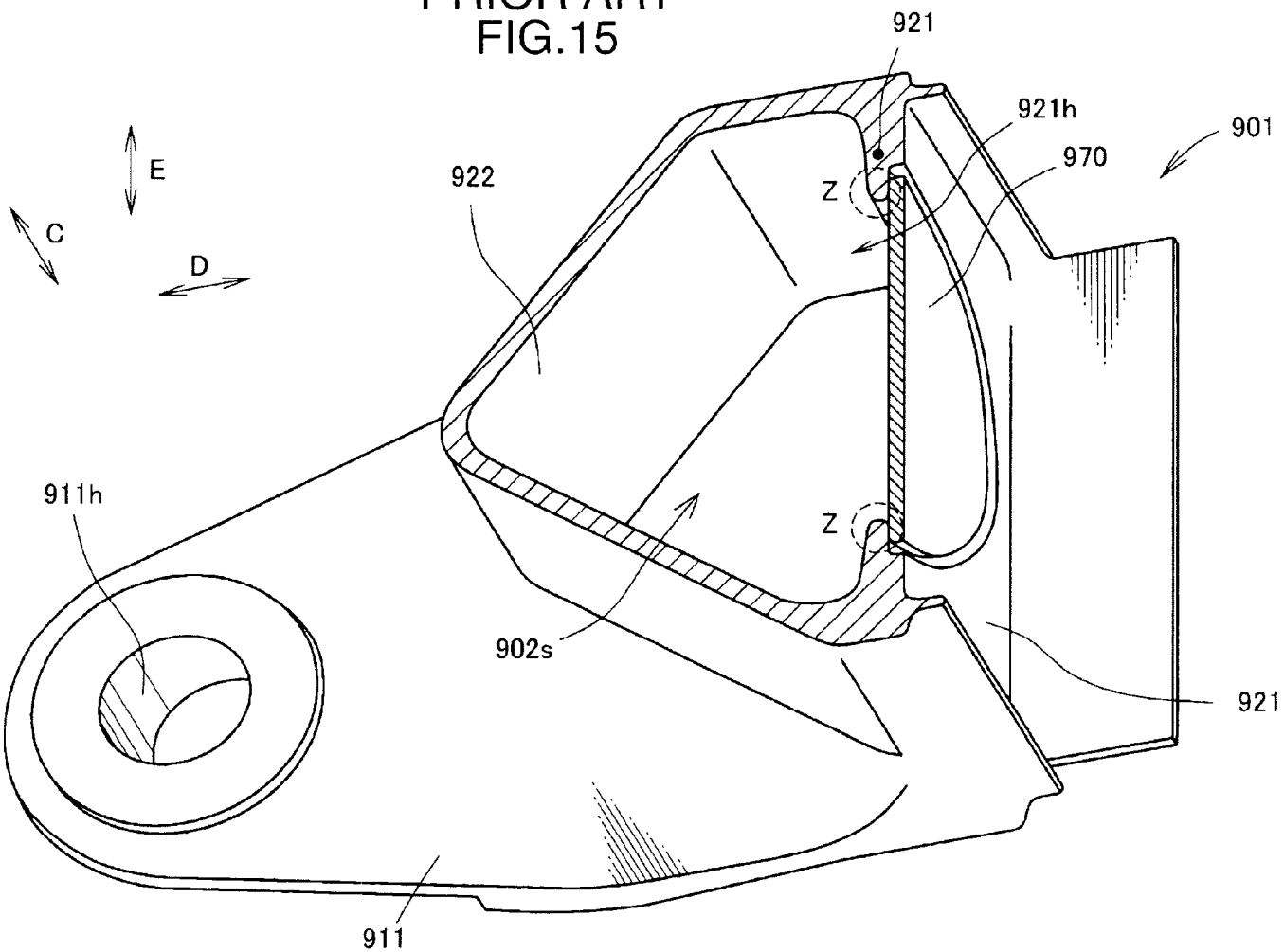
PRIOR ART FIG.15
FIG. 15 is a perspective-view diagram of a conventional boom top having a capping.

As a reference comparative example, another conventional boom top 901 (see FIG. 15 and FIG. 16) was tested under the same conditions.

COMPARATIVE EXAMPLE

Figure 14:
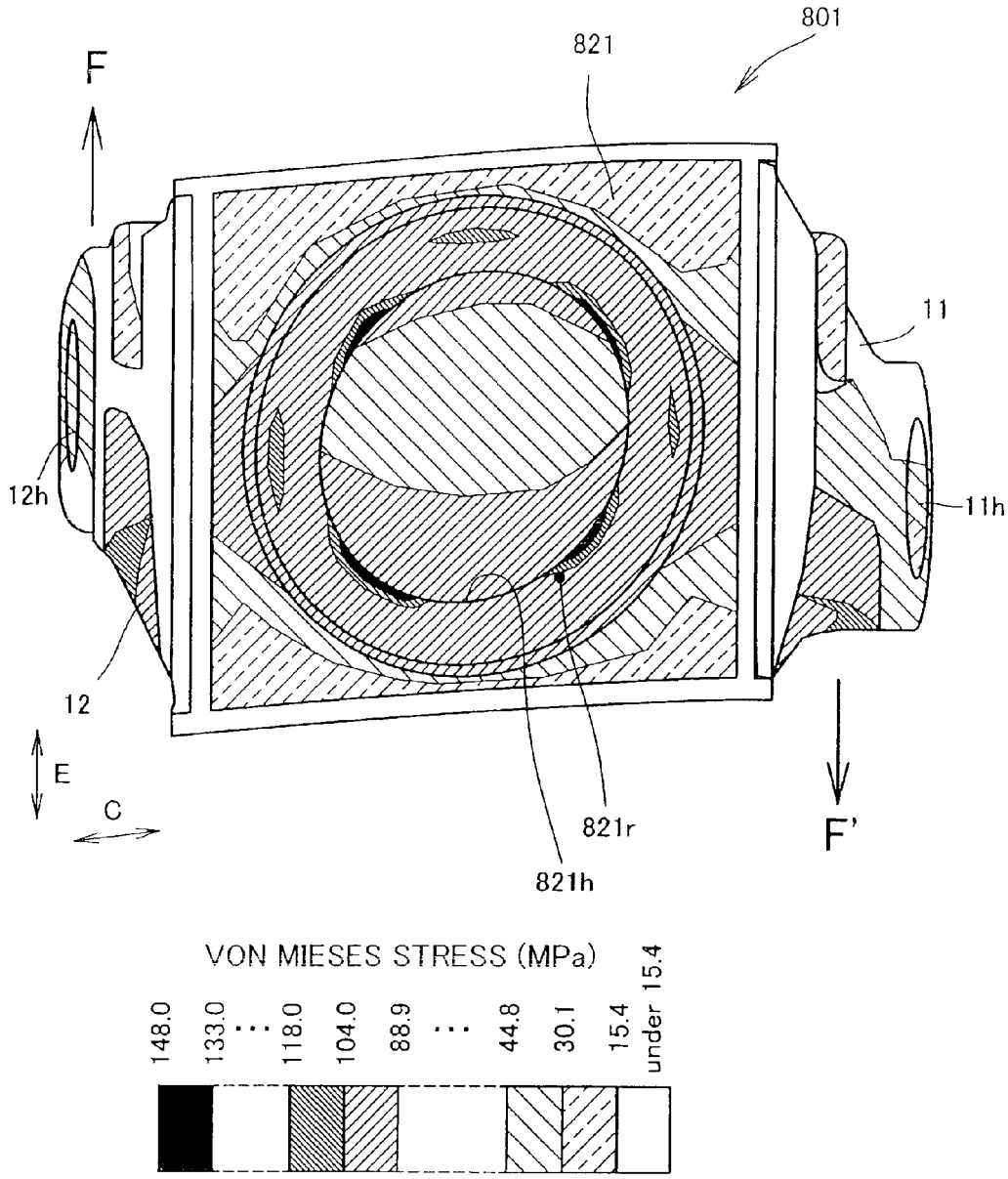
FIG. 14 is a perspective-view diagram showing results of a torsion test of a conventional boom top having no capping.

The boom top 801 of the comparative example is explained below with reference to FIG. 14. Elements identical to those of the above embodiment are denoted with the same reference numerals, and a recurrent explanation thereof will be omitted. The portions denoted with the reference numerals 801, 821, 821*h* and 821*r* correspond to the portions denoted with the reference numerals 101, 121, 21*h* and 121*r* in the embodiment above, respectively.

The boom top 801 has a bottom plate 821 and a cover plate disposed at a position facing the arm 84. In FIG. 14, what is in sight at the depth of the draw-out hole 821*h* is the cover plate. No cap is provided in the boom top 801, thus opening the draw-out hole 821*h*.

There is provided no projection protruding in the draw-out directions D on the edge 821*r* facing the draw-out hole 821*h* of the bottom plate 821.

The thickness of the edge 821*r* of the bottom plate 821 is equal to the minimum thickness (t9) of the cover plate. This means that the edge 821*r* of the bottom plate 821, differently from the edge 121*r*, is not thickened to be reinforced.

Comparative Example Test Results

The same torsion test as above was carried out in the comparative example. This resulted in that, in the comparative example, the maximum stress occurred at the edge 821*r*. Specifically, the maximum stress occurred at four positions on the two diagonals of the bottom plate 821 (that is, two lines inclined to the axial directions C at respective angles of 45 and −45 degrees), having values of about 148 MPa as shown in FIG. 14. FIG. 14 shows test results on pulsating stress.

Test Results of the Reference Comparative Example

Figure 16:
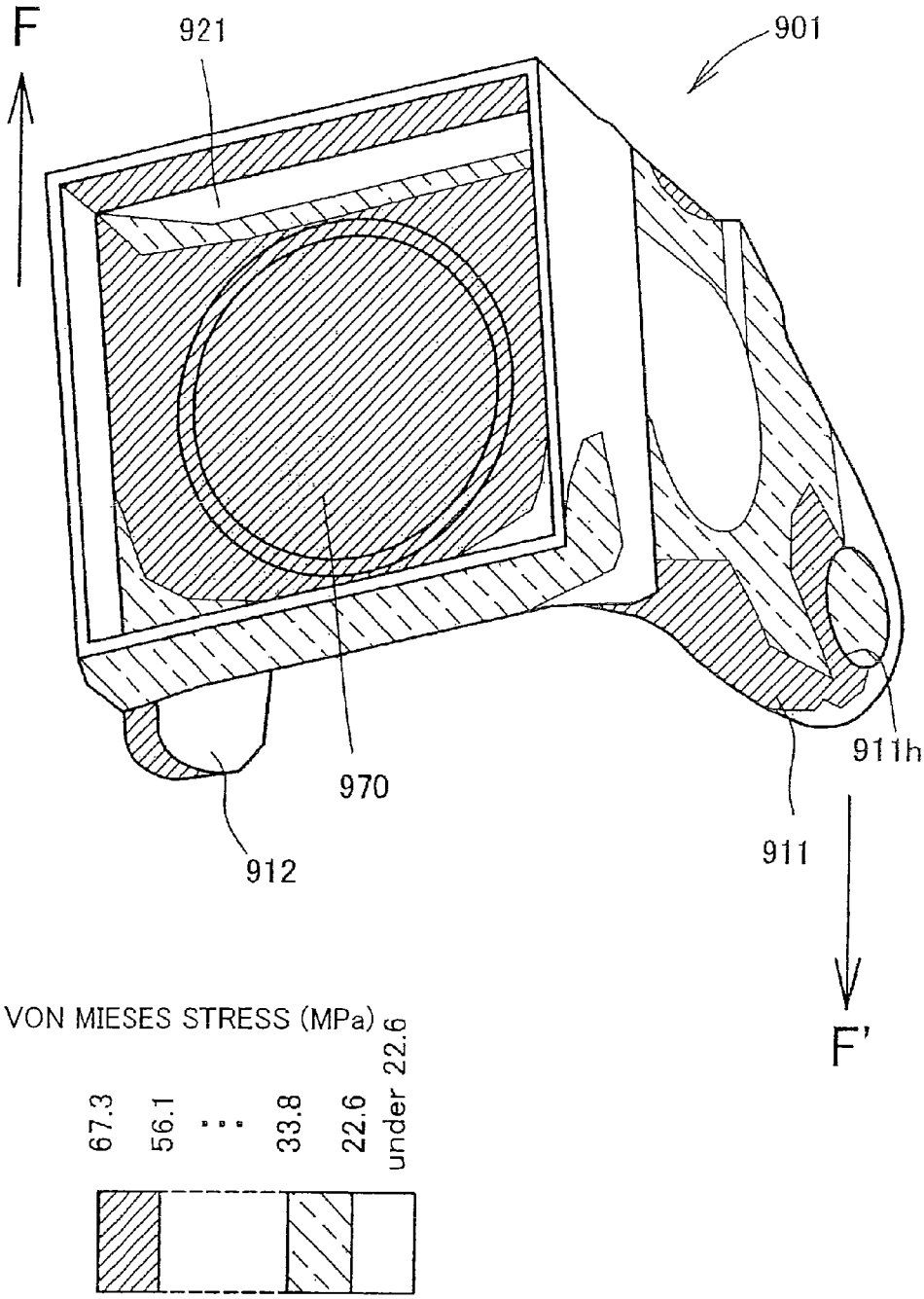
FIG. 16 PRIOR ART
FIG. 16 is a front perspective-view diagram showing results of a torsion test of the boom top of FIG. 15.

The similar torsion test was carried out for the reference comparative example. This resulted in that, in the reference comparative example, a maximum stress occurred at an edge Z of the bottom plate 921 was about 70 MPa as shown in FIG. 16). FIG. 16 shows test results on pulsating stress.

Working Example Test Results

Here are explained the test results of the working example according to the invention (that is, numerical analysis results).

Figure 8:
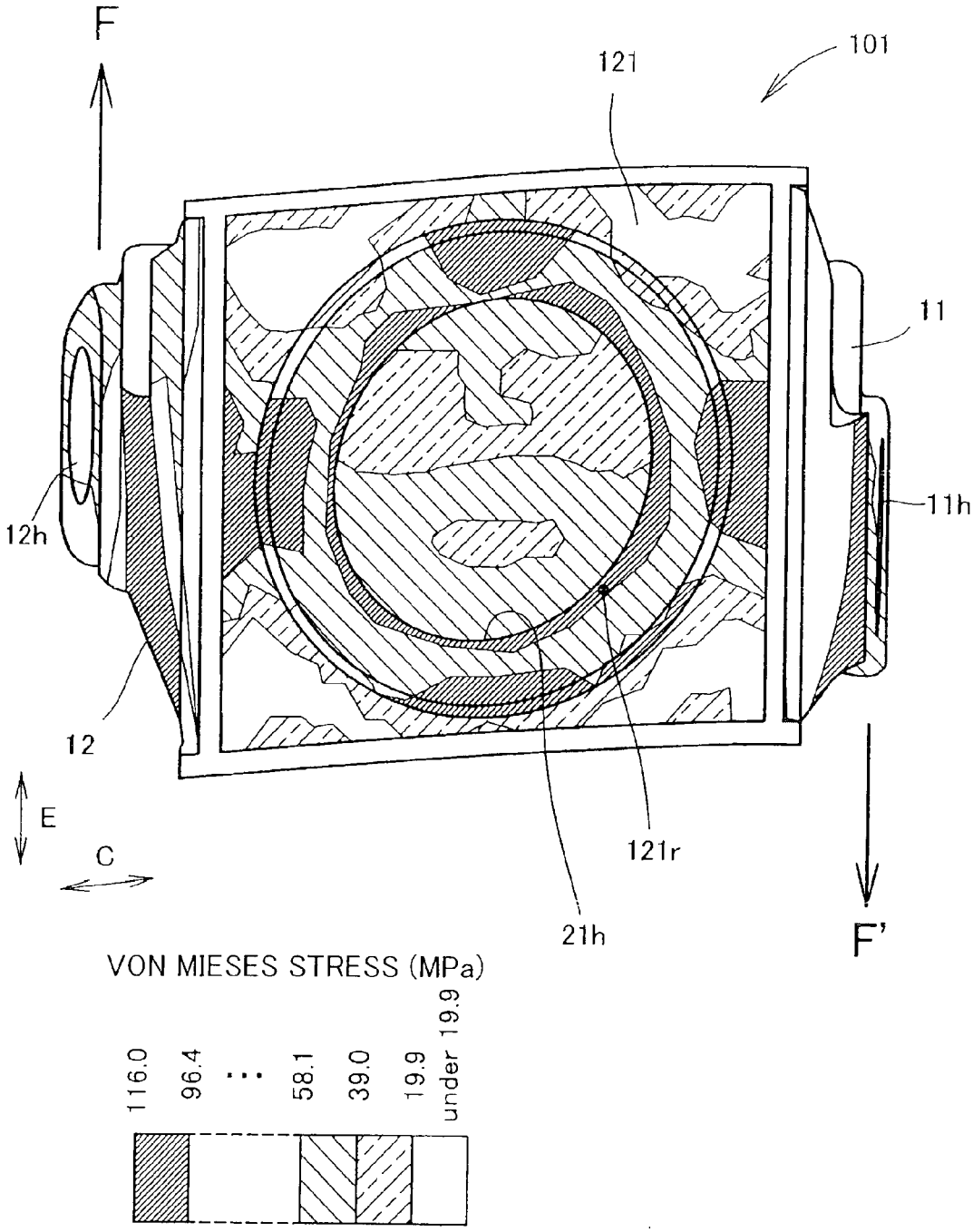
FIG. 8 is a front perspective-view diagram showing results of a torsion test of the boom top of FIG. 7.

The boom top 101 according to the present example had a maximum stress at the edge 121*r*, as shown in FIG. 8 (FIG. 8 shows test results for pulsating stress): the value of the maximum stress was 115 MPa. The maximum stress generated at the edge 121*r* in the boom top 101 was thus suppressed compared with that of the comparative example (about 148 MPa), enough to put the value of the maximum stress into the allowable stress range.

The above results shows that the structure of the boom top 101 gives its bottom plate a sufficient strength without the cap 970. This results in an effective reduction in the weight of the boom top 101.

Specifically, in a 20-ton class excavator, the weight of the cap 970 is of about 5 kgf. This means that no use of the cap can reduce the weight by 5 kgf in comparison with the conventional boom top 901. Meanwhile, setting the thickness of the main body 121*w* in the boom top 101 to t3 (that is, thickening to reinforce) raises the weight of the bottom plate 121 by 2 kgf vis-à-vis the weight of the bottom plate 921 (having no cap) of the conventional boom top 901. Accordingly, the bottom plate 121 of the boom top 101 is allowed to be lighter by 3 kgf (=5 kgf-2 kgf) with respect to the conventional bottom plate 921.

Reference Embodiment

A reference embodiment is explained next. In this embodiment, the above "edge thickness" is defined as in (i) or (ii) below.

(i) The "edge thickness" is basically the average thickness (arithmetic mean, geometric mean or harmonic mean) of the entire bottom plate.

(ii) In the case that the bottom plate has a flat-plate portion including a pair of faces parallel to each other, the "edge thickness" is the thickness of the flat-plate portion.

(Modifications)

Next are explained modifications of the first embodiment with reference to FIG. 9. Elements identical to those of the above embodiment are denoted with the same reference numerals, and a recurrent explanation thereof will be omitted. The explanation below focuses on portions that are different from those of the first embodiment. Features identical to those of the first embodiment will not be explained again. The portions denoted by the reference numerals 221A, 221C, 221E, 221G and 221J correspond all to the portion denoted by the reference numeral 21*t* in the embodiment above, respectively. The thickness t1 and t2 correspond to respective t1 and t2 in the above embodiment.

As described above, FIG. 9C, FIG. 9D, FIG. 9E, FIG. 9F and FIG. 9G show respective cross sections which are perpendicular to the axial directions C, among the cross sections which are parallel to the draw-out directions D and containing the center of the draw-out hole.

FIG. 9C shows a bottom plate according to a first modification. Two projections, namely, a projection 221A and a projection 221B, are formed on the edge of the bottom plate. The projection 221A protrudes in the direction D1 of the draw-out directions D, and the projection 221B protrudes the direction D2 thereof. In the present modification, the projections protrude in both of the directions D1 and D2, which makes the thickness t4 of the edge be greater than t1. The protrusion extent of the projection 221A (that is, the length of the portion protruding in the draw-out directions D beyond the main body 21*w*) is equal to the protrusion extent of the projection 221B. As shown here, the cross section of the bottom plate (specifically, cross section perpendicular to the direction along the edge of the draw-out hole 21*h*) may be T-shaped.

FIG. 9D shows a bottom plate according to a second modification. Also this bottom plate is formed with two projections (that is, a projection 221C and a projection 221D). The projection 221C protrudes in the direction D1 of the draw-out directions D, while the projection 221D protrudes in the direction D2 thereof. Though the thickness t4 of the edge of the present modification is equal to that in the first modification, the protrusion extent of the projection 221C is greater than that of the projection 221D, differently from the first modification.

FIG. 9E shows a bottom plate according to a third modification. Also this bottom plate is formed with two projections (that is, a projection 221E and a projection 221F). The projection 221E protrudes in the direction D1 of the draw-out directions D, while the projection 221F protrudes in the direction D2 thereof. The edge has an elliptical cross section whose long-axis extends along the draw-out directions D. The edge of the bottom plate has a thickness t5 greater than t1.

FIG. 9F shows a bottom plate according to a fourth modification. Also this bottom plate is formed with two projections (that is, a projection 221H and a projection 221G). The projection 221H protrudes in the direction D1 of the draw-out directions D, while the projection 221G protrudes in the direction D2 thereof. The edge has a cross section of an inverted triangular shape.

In the third and fourth modifications, each of the projections has a curved portion having a radius of curvature greater than that of the curved sections of the first and second modifications (bottom of the T shape), at the basal part. Specifically, the curved portions, namely a curved section 221*y* and curved section 221*x*, are respective surfaces of the joining portions of the projection.

The great radiuses of curvature in the third and fourth modifications enable generations of stress concentrations in the respective curved sections to be more effectively reduced than the first and second modifications.

FIG. 9G shows a bottom plate according to a fifth modification. In this bottom plate, though a projection 221J protrudes only in the direction D1 like in the bottom plate 21, the shape of the edge differs from that of the edge 21*r*. Specifically, the radius of curvature of a curved section 221*z*, which is the surface at the joining portion of the projection 221J and the main body 21*w*, is set to be greater than that of either of the curved section 221*x* and the curved section 221*y*. This allows stress concentration in the curved section to be reduced more effectively.

The projection can protrude in the direction D2 (that is, protrude from the bottom plate towards the inner space of the intermediate support member), or in the direction D1 (that is, from the bottom plate towards the boom).

The projections shown in FIGS. 9C to 9G can be formed uniformly over the entire perimeter of the edge, or formed in a part of the edge.

Third Embodiment

Figure 10:
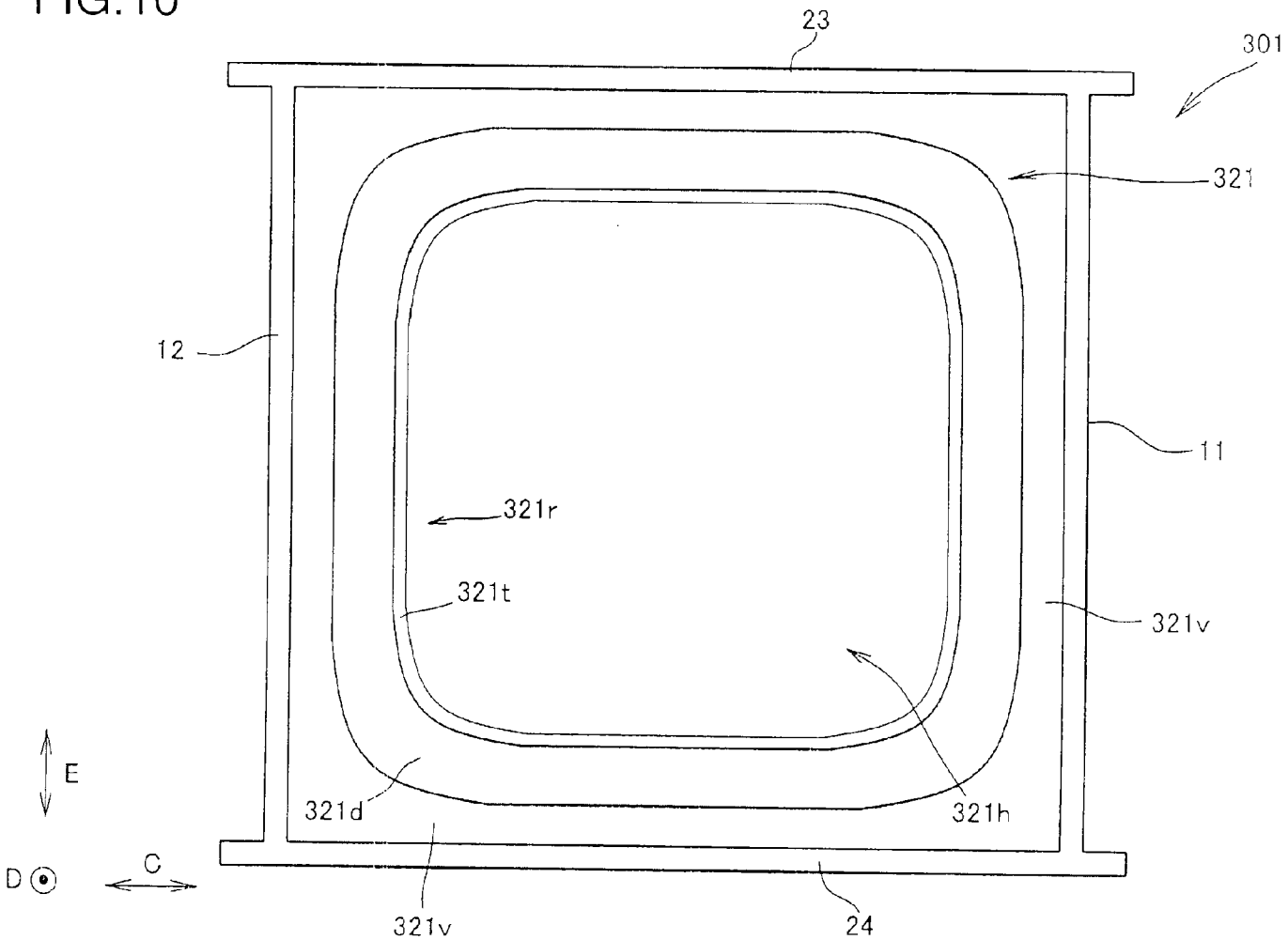
FIG. 10 is a bottom-view diagram of a boom top according to a third embodiment.

A third embodiment of the present invention will be explained with reference to FIG. 10. Elements identical to those of the above embodiment are denoted with the same reference numerals, and a recurrent explanation thereof will be omitted. FIG. 10 is a bottom-view diagram of the boom top according to the third embodiment. The explanation below focuses on portions that are different from those of the first embodiment. Features identical to those of the first embodiment will not be explained again. The portions denoted by the reference numerals 321, 321*d*, 321*h*, 321*r*, 321*t* and 321*v* correspond to the portions denoted by the reference numerals 21, 21*d*, 21*h*, 21*r*, 21*t* and 21*v* in the embodiment above, respectively.

The boom top 301 according to this embodiment, differently from the above embodiment, has a draw-out hole 321*h* shaped as not a circle but a square (with rounded corners). An edge 321*r* and a projection 321*t* are formed corresponding to the shape of the draw-out hole 321*h*. The draw-out hole may have a shape other than the above.

Fourth Embodiment

Figure 11:
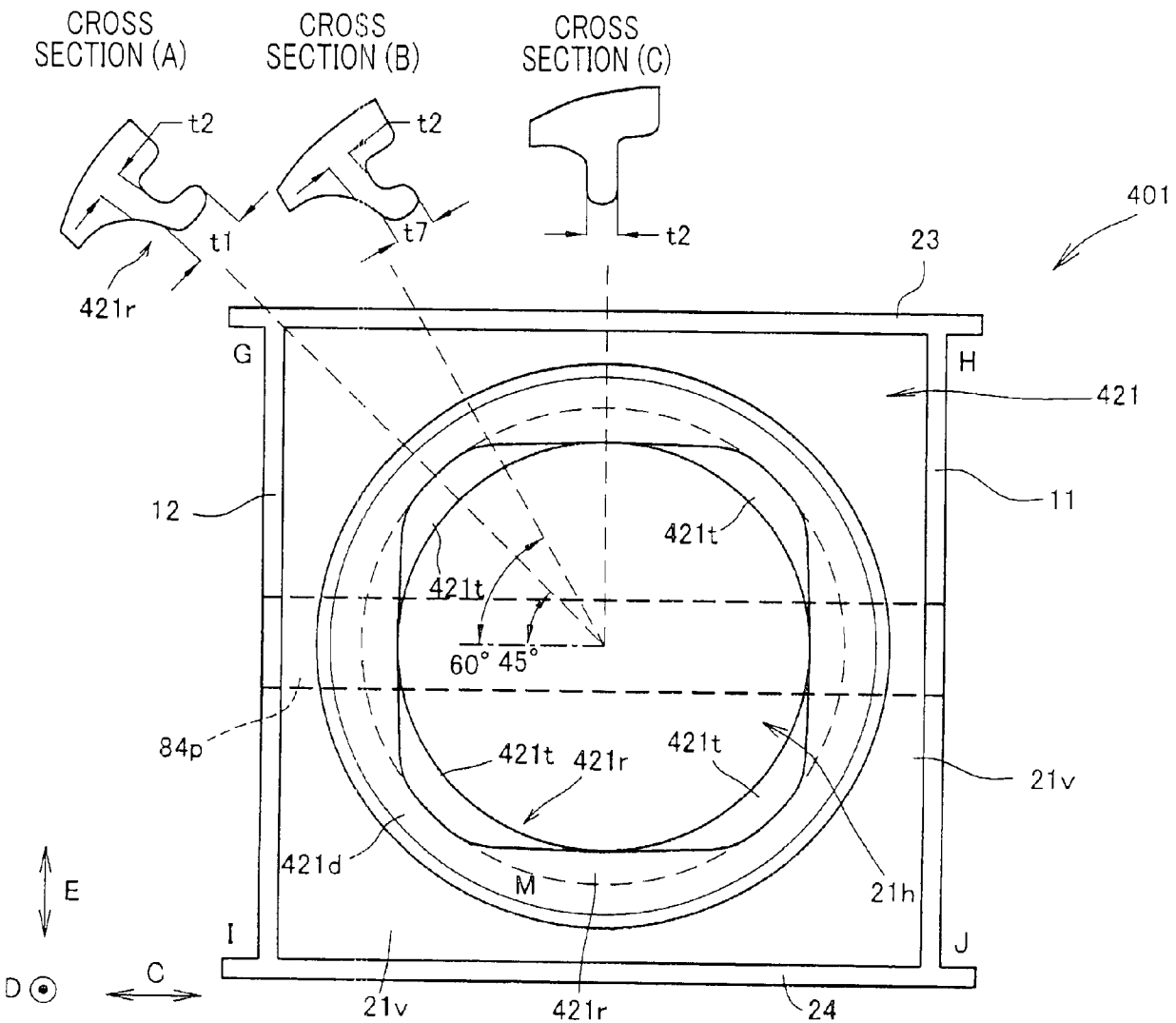
FIG. 11 is a bottom-view diagram of a boom top according to a fourth embodiment.

A fourth embodiment of the present invention will be explained with reference to FIG. 11. Elements identical to those of the above embodiment are denoted with the same reference numerals, and a recurrent explanation thereof will be omitted. FIG. 11 is a bottom-view diagram of a boom top according to the fourth embodiment. The explanation below focuses on portions that are different from those of the first embodiment. Features identical to those of the first embodiment will not be explained again. The portions denoted by the reference numerals 421, 421*d*, 421*r* and 421*t* correspond to the portions denoted by the reference numerals 21, 21*d*, 21*r* and 21*t* in the embodiment above, respectively. The thicknesses t1 and t2 correspond to t1 and t2 in the above embodiment.

The boom top 401 according to this embodiment has a bottom plate 421 whose shape is different from that of the bottom plate 21, as specifically described below.

The bottom plate 421 do not have a projection formed over the entire perimeter, but has four projections 421*t* formed in respective regions in an edge 421*r*. The edge 421*r* is a region enclosed within a broken-line circle M (excluding the draw-out hole 21*h*).

The projections 421*t* are formed in regions (i) within the area of the edge 421*r* and (ii) each of the regions includes one of two lines inclined to the axial directions C at respective angles of 45 and −45 degrees. Specifically, the four projections 421*t* in FIG. 11 are formed, in the peripheral edge of the draw-out hole 21*h*, in the respective four regions each including one of the diagonals of the bottom plate 421, that is, the straight line between G and J, and the straight line between H and I in the figure).

The thickness of the edge 421*r* is greatest on first lines, which is the diagonals, being t1 (see corresponding cross section (A) in FIG. 11). The thickness of the edge 421*r* is smallest on a second line along the axial directions C and a third line along the directions E, being t2 (see corresponding cross section (C) in FIG. 11). Any of the thickness of the edge 421*r* in the area between the first lines and the second and third lines is greater than t2 but smaller than t1. For instance, the thickness t7 of the edge 421*r* in the corresponding cross section (B) in FIG. 11 (that is, a cross section along a line tilted by 60 degrees with respect to the axial direction C) is t7 (t2<t7<t1). As described here, each of the projections 421*t* has a shape flaring in the circumferential direction of the draw-out hole 21*h*, centered on each diagonal of the bottom plate 421.

The boom top thus formed affords the following effects. The boom top 401 has the four projections 421*t* formed, in the edge 421*r*, in the respective four regions each including one of the lines inclined to the axial directions C of the arm pin 84*p* at respective angles of 45 and −45 degrees; this allows the thickness of the various sections of the boom top 401 to be optimized in terms of reducing the overall weight of the boom top 401 and reducing local stress concentration, when it is known that the rotation of the arm pin 84*p* involving the rotation of the axial directions C thereof will cause a stress concentration in the bottom plate 421.

(Modification)

In a modification of the present embodiment, the projections 421*t* of the edge 421*r* in FIG. 11 is permitted to be replaced by the main body 121*w* of FIG. 7 (that is, a portion of the bottom plate reinforced through thickening). This modification involves no projections on the edge.

Specifically, the thickness t3 of the edge facing the draw-out hole in the bottom plate, at positions on lines inclined to the axial direction C of the arm pin at respective angles of 45 degrees and −45 degrees, may be greater than the minimum thickness t9 of the cover plate 22.

This allows the thickness of the various sections of the boom top to be optimized in terms of reducing the overall weight of the boom top and reducing local stress concentration, when it is known that the rotation of the arm pin 84*p* involving the rotation of the axial directions C thereof will cause a stress concentration in the bottom plate 421.

Other Embodiments

The present invention are not limited to the above-described embodiments. The connecting member, for instance, can be also used as a boom foot, which is a member interconnecting the main body and the boom.

Although the invention has been described with reference to the preferred embodiments in the attached figures, it is noted that equivalents may be employed and substitutions made herein without departing from the scope of the invention as recited in the claims.

As described above, the present invention provide a castable connecting member of a construction machine, which member has a light weight and a high strength while requiring no welding operation for forming itself.

(1) In order to solve the above problems, the invention provides a first connecting member of a construction machine. The member is a casting for connecting a boom and an arm, comprising: a first support plate having a first shaft hole through which an arm pin is inserted; a second support plate disposed parallel to the first support plate and having a second shaft hole through which the arm pin is inserted; and an intermediate support member being continuous with the first and second support plates and disposed between the first and second support plates.

The intermediate support member, inside which a space is formed, has (i) a bottom plate formed with a draw-out hole for drawing a casting mold out of the intermediate support member and disposed at a position facing the boom, and (ii) a cover plate which is continuous with the bottom plate and disposed at a position facing the arm so as to cover the draw-out hole. Moreover, a projection protruding in a draw-out direction of the casting mold is formed in at least a part of an entire perimeter of an edge facing the draw-out hole, in the bottom plate.

In this connecting member, which is manufactured by casting, the thickness of the various sections of the connecting member is allowed to be designed in consideration of both local stress concentration and reduction of the weight of the entire connecting member.

No use of capping part enables the connecting member to be lighter than a connecting member having a capping part. Furthermore, no requirement of welding the capping part allows the time and cost for manufacturing the connecting member to be decreased compared with a case of welding a capping part.

The projection formed in the edge reinforces the edge, thereby suppressing the breakage in the bottom plate due to a torsional load acting on the connecting member to generate a stress concentration in the edge.

Thus provided is a lightweight and highly strong connecting member requiring no welding operation.

As to interconnecting the connecting member and the boom, the connecting member can be inserted into the boom, or, conversely, the boom can be inserted into the connecting member. The connecting member is permitted to be provided with fins which are inserted into the boom.

Disposing the first and second support plates "parallel to each other" includes any embodiment where the angle between the first and second support plates is within a range from −5 degrees to 5 degrees.

The direction in which the projection protrudes may be a direction from the bottom plate towards the inner space of the intermediate support member, or a direction from the bottom plate towards the boom. Moreover, the projection may also protrude in both of the directions.

The projection of the edge can be formed over the entire perimeter of the edge, or in a part of the edge.

(2) In the connecting member of (1) according to the present invention, the projection may be formed over the entire perimeter of the edge. This makes it possible to reliably reinforce the bottom plate even when where the stress will occur in the edge cannot be predicted.

(3) In the connecting member of (1) according to the present invention, the projection may be formed, in the edge, in a region including a line inclined to an axial direction of the arm pin. This allows the thickness of the various sections of the boom top to be optimized in terms of reducing the overall weight of the boom top and reducing local stress concentration, when it is known that the rotation of the arm pin involving the rotation of the axial direction thereof will cause a stress concentration in the bottom plate in a direction inclined to the axial direction.

The projection, which is positioned in a "line inclined to the axial direction of the arm pin", can be shaped linearly along the "line inclined to the axial direction of the arm pin", or shaped not linearly but shaped so as to flare in the circumferential direction of the draw-out hole.

The angle between the "line inclined to the axial direction of the arm pin" and the axial direction is preferably within a range from 30 degrees to 60 degrees (or from −60 degrees to −30 degrees).

(4) In order to solve the above problems, the invention also provides a second connecting member of a construction machine. The member is a casting for interconnecting a boom and an arm, comprising: a first support plate having a first shaft hole through which an arm pin is inserted; a second support plate disposed parallel to the first support plate and having a second shaft hole through which the arm pin is inserted; and an intermediate support member being continuous with the first and second support plates and disposed between the first and second support plates.

The intermediate support member, inside which a space is formed, has (i) a bottom plate formed with a draw-out hole for drawing a casting mold out of the intermediate support member and disposed at a position facing the boom, and (ii) a cover plate which is continuous with the bottom plate and disposed at a position facing the arm so as to cover the draw-out hole. Moreover, at least a part of the entire perimeter of the edge facing the draw-out hole, in the bottom plate, has a thickness greater than the minimum thickness of the cover plate.

In this connecting member, which is manufactured by casting, the thickness of the various sections of the connecting member is allowed to be designed in consideration of both local stress concentration and reduction of the weight of the entire connecting member.

No use of capping part enables the connecting member to be lighter than a connecting member having a capping part. Furthermore, no requirement of welding the capping part allows the time and cost for manufacturing the connecting member to be decreased compared with a case of welding a capping part.

Moreover, the edge of the bottom plate, which is thicken to be reinforced, suppresses an breakage in the bottom plate due to a torsional load acting on the connecting member to generate a stress concentration in the edge.

Thus provided is a lightweight and highly strong connecting member requiring no welding operation.

The thickness of the "edge" is defined as the thickness of the bottom plate at a position removed from the leading end of the edge by ⅓ of the height thereof with respect to a base.

The portion thickened to be reinforced can be formed over the entire perimeter of the edge, or in a part of the edge.

"Interconnecting the connecting member and the boom" and "parallel" have the same import as described above; hence, an explanation thereof will be omitted.

(5) In the connecting member of (4) according to the present invention, the thickness of the portion of the bottom plate facing the draw-out hole, in the bottom plate, is preferably greater than the minimum thickness of the cover plate, over the entire perimeter of the portion. This makes it possible to reliably reinforce the bottom plate even when where the stress will occur in the edge cannot be predicted.

(6) In the connecting member of (4) according to the present invention, it is also preferable that the thickness of the edge facing the draw-out hole, in the bottom plate, at a position in a line inclined to an axial direction of the arm pin, be greater than the minimum thickness of the cover plate. This allows the thickness of the various sections of the boom top to be optimized in terms of reducing the overall weight of the boom top and reducing local stress concentration, when it is known that the rotation of the arm pin involving the rotation of the axial direction thereof will cause a stress concentration in the bottom plate in a direction inclined to the axial direction.

The reinforced portion of the edge, positioned in a "line inclined to the axial direction of the arm pin", can be shaped linearly along the "line inclined to the axial direction of the arm pin", or shaped not linearly but shaped so as to flare in the circumferential direction of the draw-out hole.

As to the "line inclined to the axial direction of the arm pin", an effect similar to one described above is created.

This application is based on Japanese patent application serial no. 2009-126494, filed in Japan Patent Office on May 26, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

We claim:

1. A connecting member for use in a construction machine having a boom and an arm, the connecting member being cast and adapted for connecting the boom and the arm, comprising:

a first support plate having a first shaft hole through which an arm pin is inserted;

a second support plate disposed parallel to the first support plate and having a second shaft hole through which the arm pin is inserted; and an intermediate support member being continuous with the first and second support plates and disposed between the first and second support plates, a space being formed inside the intermediate support member, wherein the intermediate support member has (i) a bottom plate disposed at a position facing the boom and formed with a draw-out hole for drawing out a casting mold having been used in the cast molding of the connecting member, the draw-out hole having an axis agreeing with a center of the bottom plate, and (ii) a cover plate being continuous with the bottom plate and disposed at a position facing the arm so as to cover the space; and the bottom plate has at least four projections protruding toward the boom on an innermost perimeter edge defining the draw-out hole, the at least four projections each having an inner peripheral wall and an outer peripheral wall and being disposed at four intersecting locations at which the innermost perimeter edge, and two diagonals passing the center of the bottom plate, intersect each other.

2. The connecting member for use in a construction machine according to claim 1, wherein the four projections extend along the innermost perimeter edge to join one another.

3. The connecting member for use in a construction machine according to claim 2, wherein said bottom plate has a main body, a thick section provided in an outer end portion of the main body, the thick section protruding toward the boom to thereby form a groove in combination with the joined projections.

4. The connecting member for use in a construction machine according to claim 3, wherein said main body and said thick section are perpendicular to the axis of the draw-out hole.

5. The connecting member for use in a construction machine according to claim 3, wherein the draw-out hole is in the form of a circle, and the groove is in the form of a ring.

6. The connecting member for use in a construction machine according to claim 2, wherein the protruding amount of the projection changes along the innermost perimeter edge, the protruding amount is greatest at the intersecting location and decreases as advancing further away from the intersecting location.

7. The connecting member for use in a construction machine according to claim 1, wherein the bottom plate has a rectangular shape, and the draw-out hole is in the form of a circle.

8. The connecting member for use in a construction machine according to claim 7, wherein the cover plate includes a first fin disposed between one ends of the first and second support plates, and a second fin disposed between the other ends of the first and second support plates, the first and second fins extending toward the boom beyond the bottom plate to thereby form a rectangular space by combination with the first and second support plate.

* * * * *